US005124747A

United States Patent [19]

Haneda et al.

[11] Patent Number: 5,124,747

[45] Date of Patent: Jun. 23, 1992

[54] COLOR COPY MACHINE WITH DETACHABLE PROCESS CARTRIDGE

[75] Inventors: Satoshi Haneda; Masakazu Fukuchi; Hisashi Shoji; Shunji Matsuo; Shizuo Morita, all of Hachioji, Japan

[73] Assignee: Konica Corporation, Tokyo, Japan

[21] Appl. No.: 758,445

[22] Filed: Sep. 5, 1991

Related U.S. Application Data

[63] Continuation of Ser. No. 438,530, Nov. 17, 1989, abandoned.

[30] Foreign Application Priority Data

Nov. 21, 1988 [JP] Japan ..... 63-295665
Dec. 19, 1988 [JP] Japan ..... 63-321521

[51] Int. Cl.[5] ..... G03G 15/00

[52] U.S. Cl. ..... 355/200; 355/210; 355/326

[58] Field of Search ..... 355/210, 200, 260, 211, 355/326, 327, 245

[56] References Cited

U.S. PATENT DOCUMENTS

| | | | |
|---|---|---|---|
| 4,376,577 | 3/1983 | Okamoto | 355/211 |
| 4,542,976 | 9/1985 | Kasamura | 355/200 |
| 4,575,221 | 3/1986 | Onoda et al. | 355/211 X |
| 4,609,276 | 9/1986 | Mitzutani | 355/210 |
| 4,682,880 | 7/1987 | Fujii et al. | 355/327 |
| 4,702,587 | 10/1987 | Miyoshi | 355/200 |
| 4,803,510 | 2/1989 | Maeda | 355/210 |
| 4,878,091 | 10/1989 | Morita et al. | 355/260 |

FOREIGN PATENT DOCUMENTS

| | | |
|---|---|---|
| 287122 | 10/1988 | European Pat. Off. . |
| 3404438 | 8/1984 | Fed. Rep. of Germany . |

OTHER PUBLICATIONS

Patent Abstracts of Japan, vol. 11, No. 358 (p-639) (2805), Nov. 21, 1987; JPA-62-134654, Jun. 17, 1987.
Patent Abstracts of Japan, vol. 13, No. 1 (P-808) (3349), Jan. 6, 1989; JPA-63-210951, Sep. 1, 1988.

*Primary Examiner*—R. L. Moses
*Assistant Examiner*—Sandra L. Brasé
*Attorney, Agent, or Firm*—Jordan B. Bierman

[57] ABSTRACT

The invention provides a color image forming apparatus provided with an image carrying unit including a rotatable photoreceptor, a developing unit including a plurality of developing devices, and a cleaning unit. The apparatus is formed with a lower casing and an upper casing. In the upper casing, the image carrying unit, the developing unit and the cleaning unit are accommodated, in which at least two kinds of the units are incorporated in a cartridge capable of being detachably installed in the upper casing. The upper casing is adapted pivotal between an open position and an operation position around an axis which is disposed parallel to the rotation axis of the photoreceptor. When the upper casing is pivotted to the open position, the developing unit is so disposed that a side of the developing unit facing the photoreceptor becomes higher than other side of the developing unit.

4 Claims, 14 Drawing Sheets

COLOR COPY MACHINE WITH DETACHABLE PROCESS CARTRIDGE

This application is a continuation of application Ser. No. 07/438,530, filed Nov. 17, 1989, now abandoned.

BACKGROUND OF THE INVENTION

The present invention relates to a color image forming apparatus of an electrophotography type, and in particular to a color image forming apparatus which is small in size, highly maintainable and is excellent in clearing jams.

In an electrophotographic image forming apparatus that forms a full-color image or a monochromatic image, there are arranged around a photoreceptor drum, a charging unit that charges the photoreceptor drum, an image-wise exposure means by which the photoreceptor drum is exposed to an image, a developing unit by which a latent image on the photoreceptor drum is developed with toners, an image-transfer unit that transfers a toner image on the photoreceptor drum to a recording paper and others.

Among the aforesaid items, the developing unit in an electrophotographic image forming apparatus for full-color images is composed of three or four developing units each containing yellow (Y), magenta (M), cyan (C) and occasionally even black (BK) toners respectively. While the photoreceptor drum makes three turns, a yellow (Y) toner image, a magenta (M) toner image, a cyan (C) toner image and occasionally a black (BK) toner image too are formed on the photoreceptor drum and those images are transferred onto a recording paper, thus a full-color image is obtained. When an image forming system of this type is used, a color image forming apparatus can be made compact by making each of three or four developing units to be of a thin type and by arranging them closely each other.

In Japanese Patent O.P.I. Publication No. 55661/1986, there is suggested a color image forming apparatus of a type of image forming mentioned above wherein a latent image is formed by means of three laser beams corresponding to three developing units, and a photoreceptor drum, developing units and a cleaning means are united to be one unit which can be taken out of an apparatus main body. Further, the color image forming apparatus described in Japanese Patent O.P.I. Publication No. 55661/1986 can contribute to the improvement in terms of maintenance, but it has a disadvantageous point that developing agents tend to spill or mix with other developers when the unit is mounted or dismounted.

Further, Japanese Patent O.P.I. Publication Nos. 72159/1983, 43170/1988 and 431711/1988 disclose an example of a color image forming apparatus wherein a toner image of each color is transferred to a recording paper by means of a transfer drum, and a photoreceptor drum and its surroundings are united to be a unit.

However, following points are enumerated for the color image forming apparatus disclosed in Japanese Patent O.P.I. Publication Nos. 72159/1983, 43170/1988 and 43171/1988.

(1) An image forming unit includes not only a photoreceptor drum and its surroundings but also a transfer drum.

(2) Both peripheral speed and the gap need to be kept in high accuracy between the photoreceptor drum and the transfer drum.

(3) A releasing mechanism needs to be provided for releasing an engagement between the photoreceptor and the transfer drum.

As stated above, a color image forming apparatus employing a transfer drum tends to be complicated in structure as shown in above Items (2) and (3), which causes it to be expensive. In addition to this, it has been impossible to obtain fully a merit of a process unit of an image forming section because image forming means are not arranged closely around the photoreceptor, which is different from a monochromatic image forming apparatus that does not need a transfer drum.

The primary object of the invention is to offer a color image forming apparatus wherein easy maintenance for the apparatus is achieved by consolidating a developing unit, an image carrier and a cleaning means together or by causing each of the combination of two of them and other remaining one to be a cartridge capable of being loaded or unloaded independently, developers are prevented in a structure from spilling out or mixing with other developers when units, especially a developing unit is inserted or drawn out by consolidating a plurality of developing units into one unit, and easy clearing of jammed recording paper is achieved in the case when a recording paper is transported defectively.

The secondary object of the invention is to offer a color image forming apparatus employing the process in which a synthetic toner image such as a color toner image composed of toners of plural colors is formed on the surface of a photoreceptor drum to be transferred onto an image-transfer paper in one transfer operation, wherein image forming means such as a plurality of developing units and cleaning units are arranged closely each other around the photoreceptor drum in order to make the apparatus small and compact, and especially a plurality of developing units each is thin in shape are arranged at one side on the circumference of the photoreceptor drum, and upper framework is arranged so that it may be opened in the direction which makes an opening operation easier to offset the imbalance that the portion of a developing unit composed of plural developing units is heavier than the other portion.

The invention further relates to a color image forming apparatus wherein the apparatus is divided vertically into two parts so that the transport plane for a recording paper may be revealed.

There has been suggested a color image forming apparatus of a clamshell type wherein the apparatus is divided vertically into two frameworks and upper framework can swing for opening and closing for the purpose of easy jam clearing for recording papers in transport as well as of easy maintenance.

In the apparatus mentioned above, units and parts related to an optical system for exposure and to an image forming section are provided in the upper framework, while units and parts related to sheet-feeding and sheet-ejecting are provided in the lower framework, which enables the transport plane for a recording paper to be releaved widely when the upper framework is opened.

On such an apparatus, therefore, it is possible to clear easily the jammed recording paper by opening the upper framework, but it is necessary to remove the units and parts forming the image forming section such as a photoreceptor drum, developing units and cleaning units from the upper framework for each maintenance.

Therefore, for the purpose of handling the image forming section as a one group and of assuring the positional accuracy of units and parts of image forming section, they are usually arranged in one cartridge as a process unit and the cartridge is mounted detachably on the upper framework.

However, it is not easy to attach or detach the units and parts from the upper framework in a opened position without touching other units and parts because the process unit is large in size and heavy in weight, and further it is necessary to pay attention to the positional accuracy for the units and parts after they are mounted again.

Overcoming and improving the problems mentioned above, the tertiary object of the invention is to offer a color image forming apparatus wherein a process unit can be mounted on or dismounted from the upper framework safely and surely through a simple operation.

SUMMARY OF THE INVENTION

The primary and secondary objects mentioned above are attained by a color image forming apparatus wherein the upper framework having therein a developing unit composed of plural developing sub-units containing respectively differently colored developers, an image carrier and cleaning means, and the lower framework are hinged, so that they may open upward at the portion opposite to the plural developing units in relation to aforesaid image carrier, around the shaft which is parallel to the rotating axis of aforesaid image carrier and, that is, the hinge is on the side of aforesaid developing unit and further is located at the side wall of the apparatus main body. Aforesaid developing unit, aforesaid image carrier and aforesaid cleaning means are consolidated together in one body or two of them are combined in one body and other remaining one is solely made in one body so as to be a cartridge capable of being loaded or unloaded independently, and an image having plural colors is formed by using plural developing devices in succession and by superposing plural developed images on aforesaid image carrier, and then the developed color image is transferred onto an image-transfer material.

Aforesaid tertiary object is achieved by a color image forming apparatus comprising an upper framework that is opened in the direction perpendicular to the axis of photoreceptor drum together with a process unit including the photoreceptor drum and plural developing units and the lower framework, wherein aforesaid process unit can be drawn out in the direction perpendicular to the axial direction of the photoreceptor drum.

DETAILED DESCRIPTION OF THE INVENTION

Figure 1A:
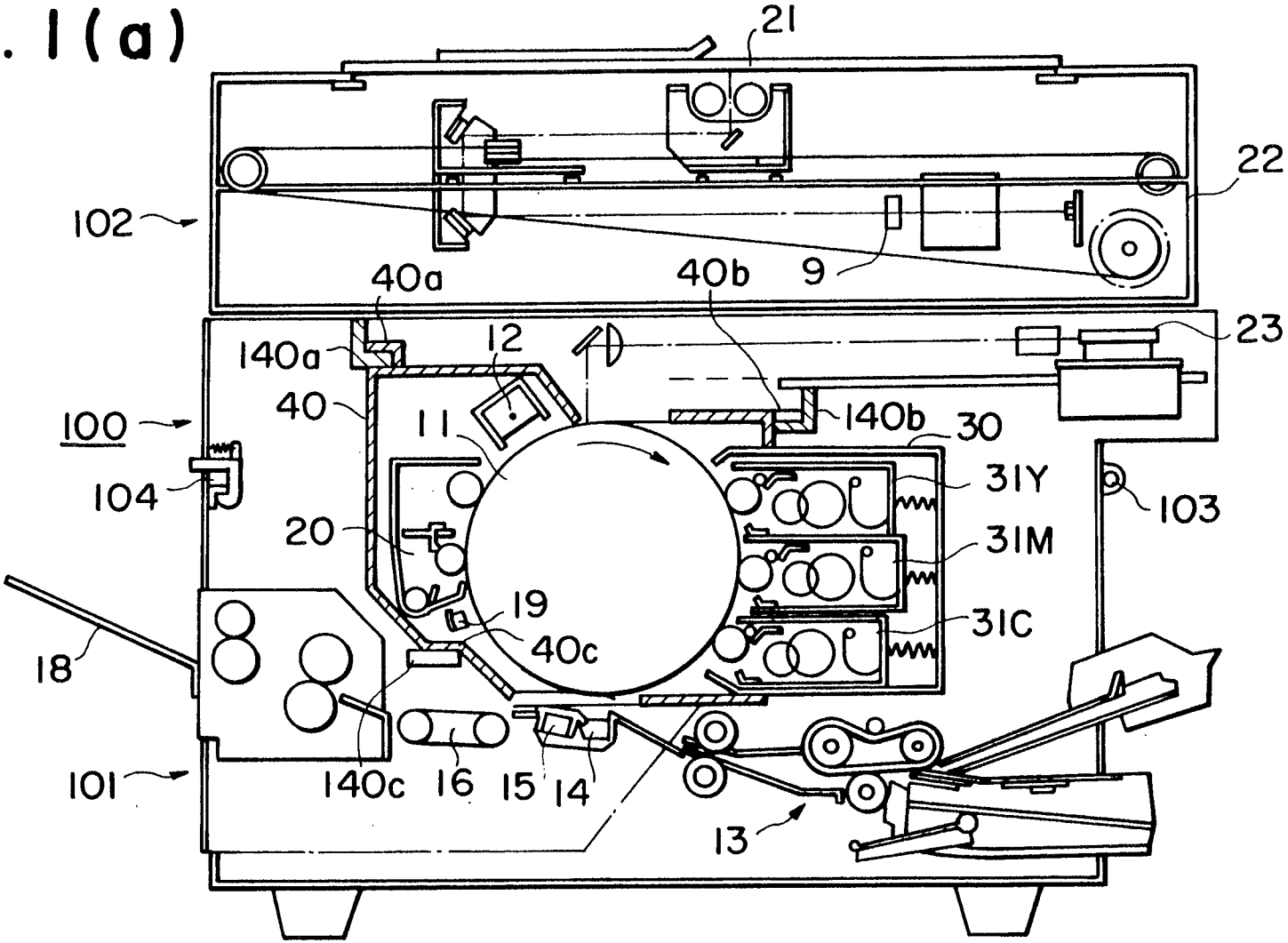
FIGS. 1 (*a*) and (*b*) represent a schematic front view of the first example of a color forming apparatus of the invention wherein FIG. 1 (*a*) shows the state of operation and FIG. 1 (*b*) shows the state in which an upper framework is opened.
Figure 1B:
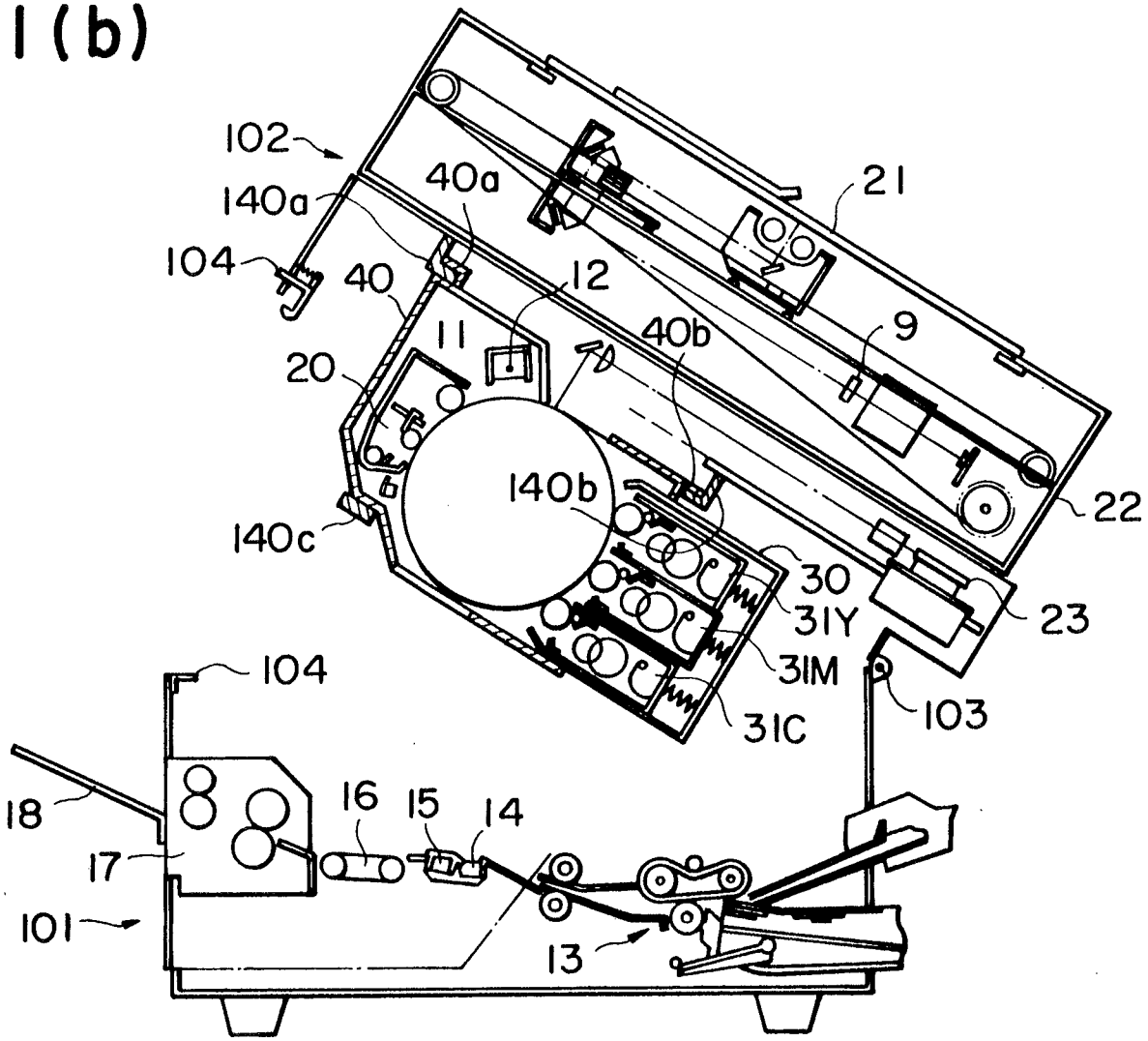

A color image forming apparatus of the invention is of a clamshell type capable of being divided into two portions of upper framework and lower framework wherein a process member that forms a color image is caused to be a unit and is attached on the framework. Prior to the explanation of its structure, however, the outline of process-related members and their actions will be explained. FIG. 1 (*a*) is a schematic structural diagram of a color image forming apparatus of the invention.

In the figure, 11 is a photoreceptor drum that is an image carrier having thereon a photoconductor layer such as an organic semiconductor, and 12 is a charging unit that charges uniformly the surface of photoreceptor drum 11 which rotates in an arrowed direction.

A document (not shown) placed on platen glass 21 is read by image-reading device 22 and the image data of a document obtained through the reading by image-reading device 22 is fed to laser exposure device 23 after being image-processed. Photoreceptor drum 11 is exposed to image light modulated based on image data from the document and coming from laser exposure device 23, and thereby a latent image is formed on the surface of photoreceptor drum I! uniformly charged by charging unit 12.

The electrostatic latent image thus formed is developed to a toner image on the surface of photoreceptor drum 11 by means of the first developing unit 31Y containing yellow (Y) color developer, the second developing unit 31M containing magenta (M) color developer and the third developing unit 31C containing cyan (C) color developer all provided in developing unit 30.

The numeral 13 represents a feeding means for the image-transfer material, 14 is a transfer unit that transfers a toner image formed on photoreceptor drum 11 onto an image-transfer material fed in by feeding means 13, 15 is a separating unit that separates the image-transfer material having thereon a transferred toner image from photoreceptor drum 11, 16 is a transport means that transports the separated image-transfer material to fixing unit 17, 18 is a copy-receiving tray that receives the image-transfer material on which a toner image is fixed by fixing unit 17, 19 is a pre-cleaning neutralizing unit that makes it easy to remove, from photoreceptor drum 11, the residual toner staying on the surface of the drum even after the transfer of the toner image thereon and 20 is a cleaning unit that removes residual toner from the surface of photoreceptor drum 11.

A color image forming apparatus in the first example has therein process cartridge 40 in which photoreceptor drum 11, developing unit 30 and cleaning unit 20 are included, and each of engaging members 40*a*, 40*b* and 40*c* provided on the outer surface of process cartridge 40 engages with each of supporting arms 140*a*, 140*b* and 140*c* all provided on the side of the main body, thus the process cartridge is held by means of unillustrated holding means In developing sub-units 31Y, 31M and 31C arranged in the developing unit 30, it is desirable that the development is carried out under the non-contact development condition wherein a developer layer that is thinner than the clearance between the developing sleeve and photoreceptor drum 11 is formed on each of developing sleeves thereof and transportation so that toners may fly out of the developer layer to be attracted to an electrostatic image on photoreceptor drum 11, because the toner image formed first on the photoreceptor drum 11 is not disturbed by the following development and the switching over between operation and non-operation of the development can easily be done by the switch over of bias voltage to be applied on a developing sleeve without the necessity of moving the developing unit.

The main bodies of developing sub-units 31Y, 31M and 31C arranged in developing unit 30 are of a thin type in structure to be mostly the same each other and are arranged almost parallel to photoreceptor drum 11 to be a compact unit.

Figure 2:
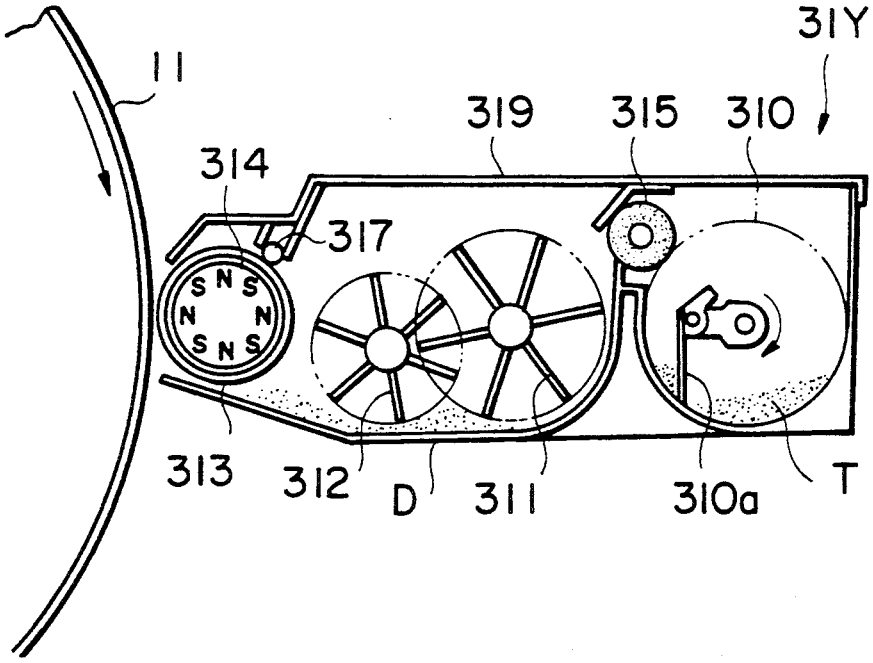
FIG. 2 is a schematic front view showing a developing unit of a color image forming apparatus of the invention.

Inside the developing sub-unit 31Y in FIG. 2, there are provided toner-containing device 310, toner-agitating vane wheel 311, toner-agitating vane wheel 312, developing sleeve 313, magnet roll 314 and toner-replenishing roller 315. On top of developing sub-unit 31Y, there is provided cover member 319 which covers toner-containing device 310, toner-agitating vane wheel 311, toner-agitating vane wheel 312, developing sleeve 313, magnet roll 314 and toner-replenishing roller 315 to prevent toner spewing. Incidentally, the clearance between developing sleeve 313 and photoreceptor drum 11 is kept by a roller (unillustrated) which is coaxial with developing sleeve 313 and contacts photoreceptor drum 11. On the bottom of toner-containing device 310, there is contained toner T which is dredged up toward the upper portion on the left side in FIG. 2 with dredging plate 310*a* that rotates clockwise.

Toner T dredged up with dredging plate 310*a* is moved to the left side in FIG. 2 by toner-replenishing roller 315 and is fed to toner-agitating vane wheel 311, in cooperation with toner-agitating vane wheel 312, agitates magnetic carrier and toner T and the counter-clockwise rotation of toner-agitating vane wheel 312 causes two-component developer D composed of magnetic carrier and toner T to stick on developing sleeve 313. Inside developing sleeve 313, there is provided magnet roll 314 having therein fixed magnetic poles, and both developing sleeve 313 and magnetic roll 314 cause a magnetic brush of developer D to be formed.

On the surface of developing sleeve 313, a thin layer of developer D is formed by the magnetic brush mentioned above. Developer thin layer forming means 317 such as, for example, a magnetic cylindrical bar arranged to oppose to the magnetic pole of magnet roll 314 is brought near to developing sleeve 313 so that a uniform thin layer of developer D which is thinner than the clearance between developing sleeve 313 and photoreceptor drum 11 may be formed. From the surface of the thin layer of developer D, toner T jumps toward electrostatic latent image on photoreceptor drum 11 by A.C. bias voltage, thus an electrostatic latent image formed on the surface of photoreceptor drum 11 is developed to be a toner image.

During the development, bias voltage composed of both D.C. and A.C. components keep being applied on developing sleeve 313, thus the fluctuation of developing conditions between developing sub-units can be adjusted by controlling the bias voltage through the method mentioned later.

Figure 3:
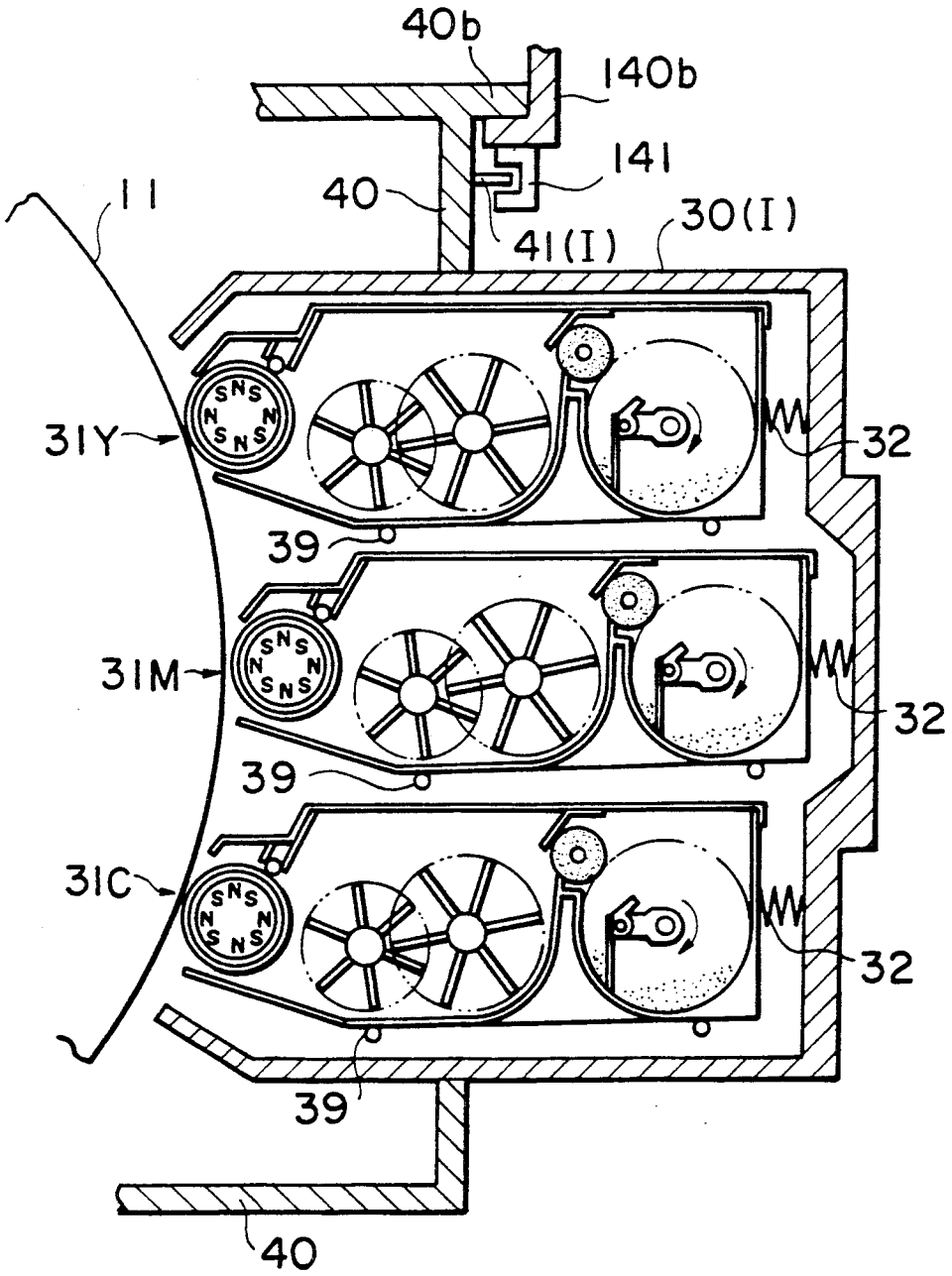
FIG. 3 is a schematic sectional view of the developing unit.

FIG. 3 shows the sectional view of developing unit 30 provided therein with developing sub-units 31Y, 31M and 31C, and the developing unit 30 is a part of process cartridge 40. Developing unit 30 is a framework having its opening on the side of photoreceptor drum 11, wherein guide member 39 composed of rollers or the like is provided, and each of developing sub-units 31C, 31M and 31Y arranged in parallel each other is guided by guide member 39 and pushed toward photoreceptor drum 11 by elastic member 32 provided and energized on the backside of each developing sub-unit, thus the distance set between developing sleeve 313 and photoreceptor drum 11 is constantly kept.

On process cartridge 40, there are provided charging unit 12 and pre-cleaning neutralizer 19, in addition to photoreceptor drum 11, developing unit 30 and cleaning unit 20. Further, when claws are used to assist the image-transfer material to be separated from photoreceptor drum 11, these claws are provided in process cartridge 40. A motor for driving the process cartridge 40 is provided on the main body 100, thus when process cartridge 40 is mounted on the main body 100, power transmission and electrical connection may be made by means of a coupling or the like. It is also naturally possible that the motor which is a source for driving is provided on the process cartridge 40. In this case, however, process cartridge 40 needs to be connected electrically immediately when it is mounted on main body 100.

Figure 4:
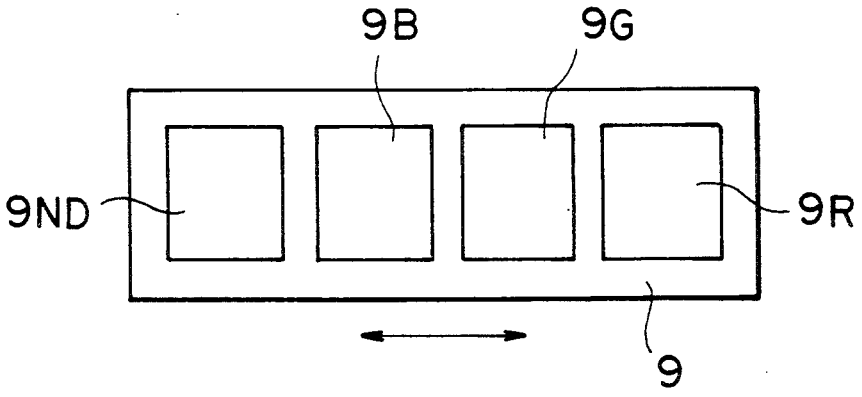
FIG. 4 is a front view showing a filter used for color separation.

When reading a document placed on platen glass 21 by means of image-reading unit 22, filter 9 is used for color separation. Filter 9, as shown in FIG. 4, is composed of filter 9R, filter 9G, filter 9B and filter 9ND, and when reading a document, any one of filter 9R, filter 9G, filter 9B and filter 9ND transmits light before reading. The selection from filter 9R, filter 9G, filter 9B and filter 9ND are made by moving filter 9 from side to side in FIG. 4 (perpendicularly to paper surface in FIG. 1) by means of filter-selecting unit 22*a* described later. Incidentally, filter 9R, filter 9G and filter 9B are filters transmitting respectively red light, green light and blue light, while filter 9ND is a neutral density filter which transmits all the three colors.

Figure 5:
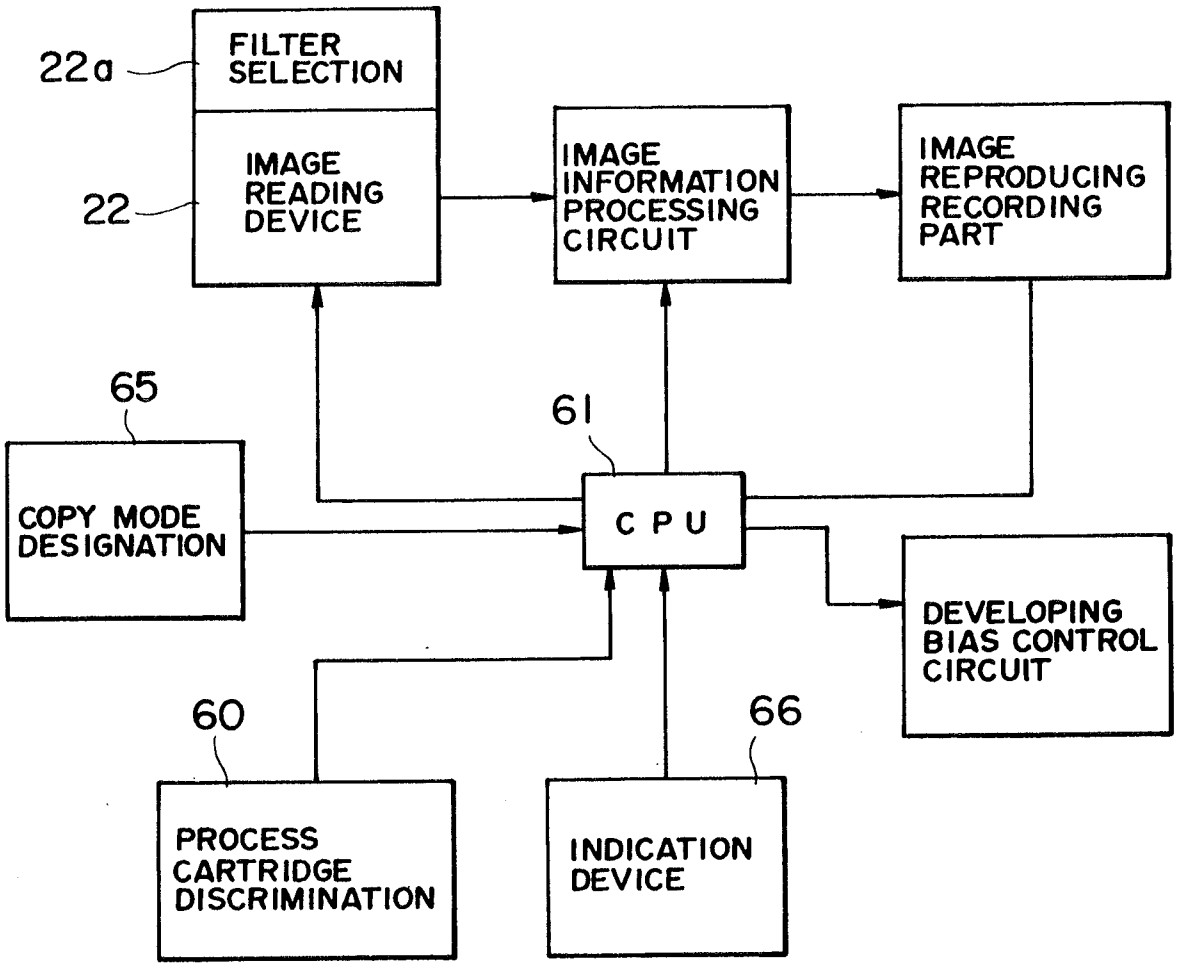
FIG. 5 is a block diagram showing a control circuit for a color imaging, FIGS. 6 (*a*) and (*b*) represent a schematic front view of the second example wherein FIG. 6 (*a*) shows the state of operation and FIG. 6 (*b*) shows the state wherein an upper framework is opened.

When process cartridge 40 is mounted on the main body 100, marking portion 41 attached on cartridge 40 is detected by detecting member 141 (FIG. 3) and is input into CPU 60 through the control circuit shown in FIG. 5. Since developing sub-units 31C, 31M and 31Y containing respectively cyan(C), magenta(M) and yellow(Y) toners are provided at pre-determined positions in developing unit 30, yellow (Y) toner image, magenta (M) toner image and cyan (C) toner image are formed on photoreceptor drum 11 in succession by means of image-wise light emitted from laser exposure unit 4 and irradiated onto photoreceptor drum 11 each time the photoreceptor drum 11 makes one turn out of its total three turns.

A toner image thus formed is transferred onto a recording paper (unillustrated) fed from paper-feeding unit 13 by means of transfer unit 14. The transferred image is heated and fixed on the recording paper by means of fixing unit 17 and after fixing, the recording paper is ejected.

For such development by means of each toner, aforesaid selection of filter 9 is made for each developing sub-unit to be operated. Namely, in FIG. 5, discriminated results from detecting member 141 through process cartridge discriminating circuit 60 are supplied to CPU 61. CPU 61, after receiving the discriminated results, gives a command to image-reading unit 22. Namely, the command is given so that the filter-setting may be made by filter selecting circuit 22*a* to satisfy that filters 9R, 9G and 9B correspond respectively to the development with cyan (C) toner in developing sub-unit 31C, development with magenta (M) toner in developing sub-unit 31M and development with yellow(Y) toner in developing sub-unit 31Y. A developing such unit in process cartridge 40 is not limited to developers in three colors of cyan(C), magenta (M) and yellow(Y), but is allowed to use black (BK) or other color combination.

By differentiating aforesaid marking portion 41 depending on developer colors and the combination thereof in process cartridge 40, the filter that matches the aforesaid conditions is automatically selected and set, thus a color copying operation is performed.

In the color image forming apparatus having functions explained above, process cartridge 40 in the present example is mounted on the upper framework 102 that is capable of being opened from or closed to the lower framework 101, which resulting in a separated structure.

FIG. 1(*b*) shows a state wherein upper framework 102 is opened. In the color image forming apparatus of the invention, hinge 103 that is an axis of opening and closing for both upper framework 102 and lower framework 101 is provided in parallel to the shaft of photoreceptor drum 11 at the position that is on the same side as developing sub-units 31Y, 31M and 31C regarding to photoreceptor drum 11 near the side surface of the framework. On the side opposite to the hinge 103, there is provided metallic hook 104 spanning both upper framework 102 and lower framework 101. When metallic hook 104 is unhooked, upper framework 102 is lifted clockwise in the figure, and the upper framework can be opened. Between lower framework 101 and upper framework 102, there are provided a balancing member such as an unillustrated energized spring member or the like and a locking member, thus it is possible to open lightly and easily upper framework 102 clockwise in the figure, and a state of the opening can be kept by the locking member even after releasing hands from the framework.

In the present example, process cartridge 40 comprising photoreceptor drum 11, cleaning units 20 and developing unit 30 located at both sides of the photoreceptor drum is mounted on upper framework 102. When the upper framework is opened, therefore, process cartridge 40 is moved upward, and each developing sleeve 313 positioned at the opening of developing sub-units 31Y, 31M and 31C located in parallel turns upward, and coincidentally, toner-containing device 310 is located at the bottom.

Since engaging members 40*a*, 40*b* and 40*c* provided on outer wall surface of process cartridge 40 are on the condition of engagement with supporting arms 140*a*, 140*b* and 140*c* all in a rail shape provided on upper framework 102, it is possible to draw out process cartridge 40 in a direction perpendicular to the surface of the paper on which FIG. 1 (*b*) is drawn, that is, in a horizontal direction in the apparatus. Since the developing portion, which is opposite to the photoreceptor drum and is on a position where the developing sleeve is arranged, becomes to face upward in each of sub-units 31Y, 31M and 31C, in this case, it does not happen that developer spills out or is mixed with other developers being caused by the shock when process cartridge 40 is taken out or inserted. Further, feeding means 13 for image-transfer paper, transfer unit 14, separating unit 15 that is a separating electrode, conveyance means 16 for image-transfer material and fixing unit 17 are all mounted on lower framework 101. Therefore, when it is necessary to clear the jam caused by defective conveyance of image-transfer paper, it is possible to clear it easily by the direct access by hand, because the conveyance path for image-transfer material can be disclosed only by opening upper framework 102 upward.

Figure 6A:
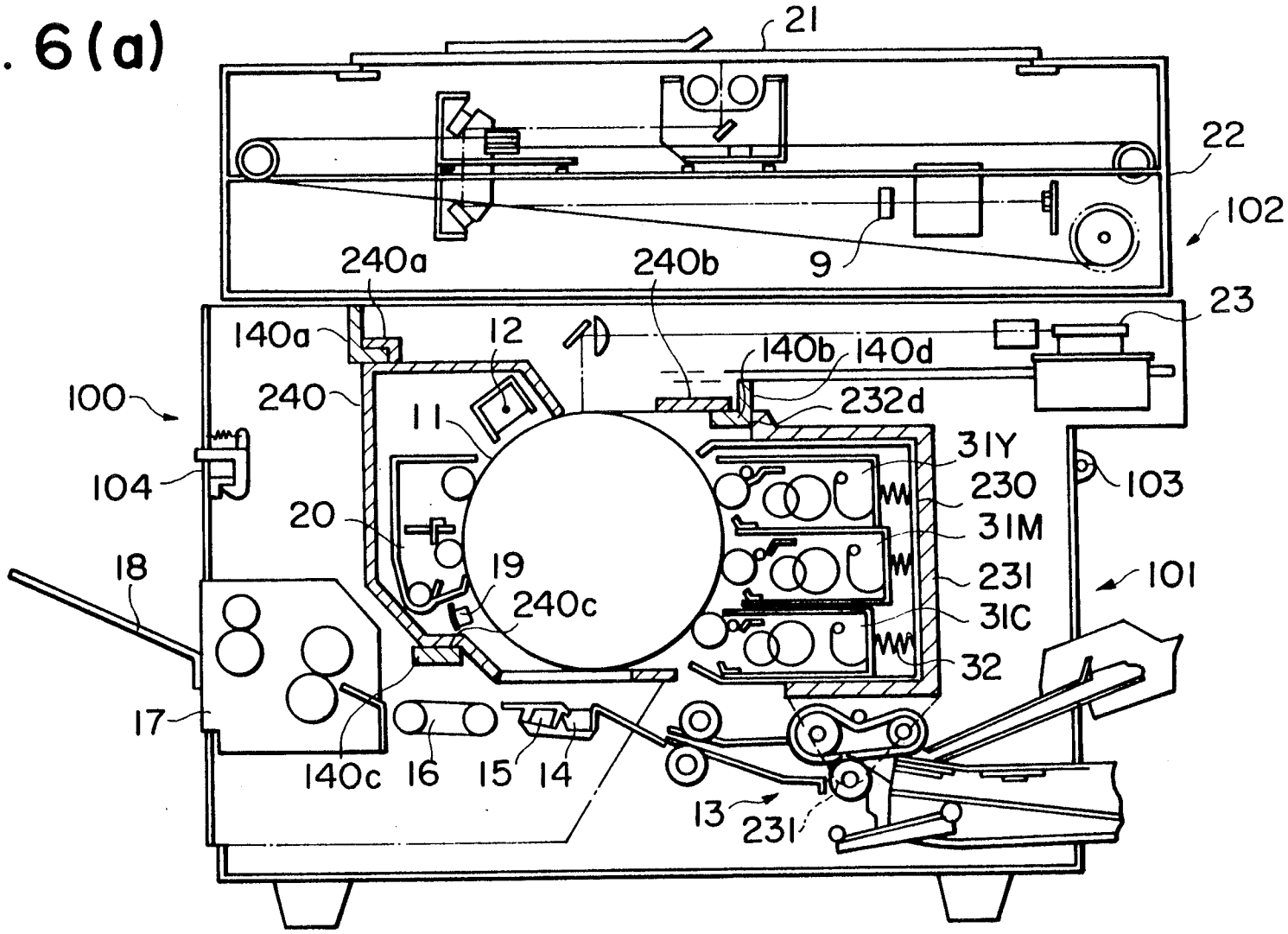
Figure 6B:
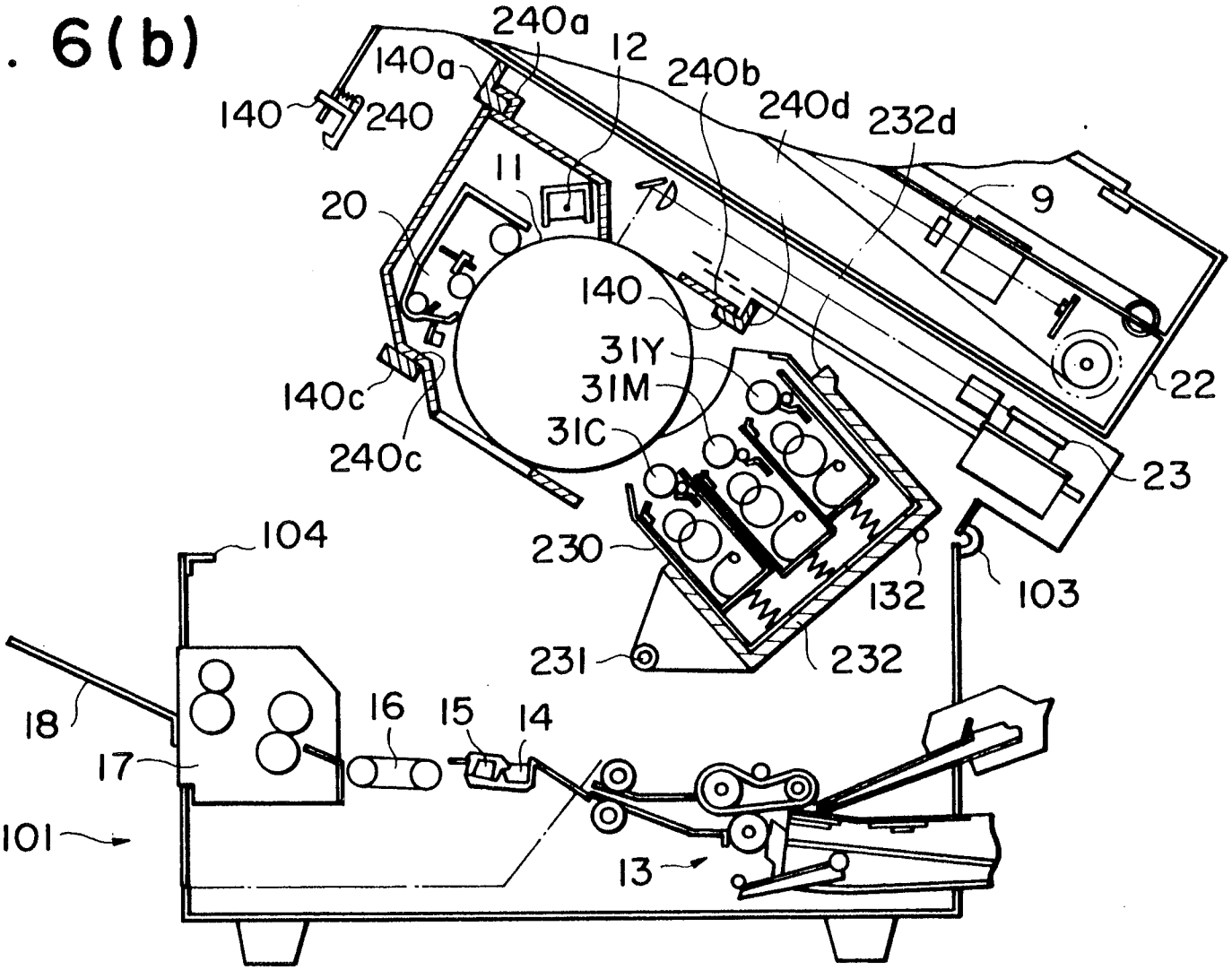

FIGS. 6(*a*) and (*b*) show the second example which has same functions as those in the first example. In the present example, photoreceptor drum 11 that is an image carrier and cleaning unit 20 are united to be process cartridge 240 which can be mounted or dismounted independently from developing unit 230 having therein developing sub-units 31Y, supported by an unillustrated supporting means on condition that engaging members 240*a*, 240*b* and 240*c* all provided on the outer wall surface of the process cartridge are in engagement respectively with supporting arms 140*a*, 140*b* and 140*c* in a rail shape. On the other hand, developing unit 230 having therein developing sub-units 31Y, 31M and 31C arranged in the same manner as that in the first example is mounted on unit garage 232 that is capable of being inserted or drawn out in the direction perpendicular to the surface of the paper on which FIG. 6 (*b*) is drawn. The unit garage 232 is capable of rotating around rotation-supporting shaft 231. Around the rotation-supporting shaft 231, spring members energized counterclockwise may be provided, if necessary.

FIG. 6 (*a*) is a structural diagram showing a state of operation in which unit garage 232 is energized counterclockwise because its center of gravity is on the left side of rotation-supporting shaft 231 in the figure, and stopper 140*d* provided on upper framework 102 is in contact with stopper member 232*d* provided on unit garage to be regulated in terms of position, and developing sub-units 31Y, 31M and 31C therein are pressed by elastic members 32 to the predetermined developing positions against photoreceptor drum 11.

FIG. 6(*b*) shows the state wherein upper framework 102 is opened after unhooking metallic hook 104 in FIG. 6(*a*). When upper framework 102 is lifted clockwise, the center of gravity of unit garage 132 on which developing unit 230 is mounted moves to the right side of rotation-supporting shaft 231 in the figure, thereby unit garage 232 rotates clockwise, aparting from photoreceptor drum 11 and stops when it hits stopper pin 32 provided on upper framework 102. Under such an opened condition, developing sub-units 31Y, 31M and 31C are in the attitude that is closer to a vertical line than that in the first example, which prevents developer from spilling out or being mixed with other developer. Further, since developing sub-units 31Y, 31M and 31C are away from photoreceptor drum 11, process cartridge 240 and developing unit 230 are capable, when they are in the opened state, of being inserted or drawn out independently.

Figure 7:
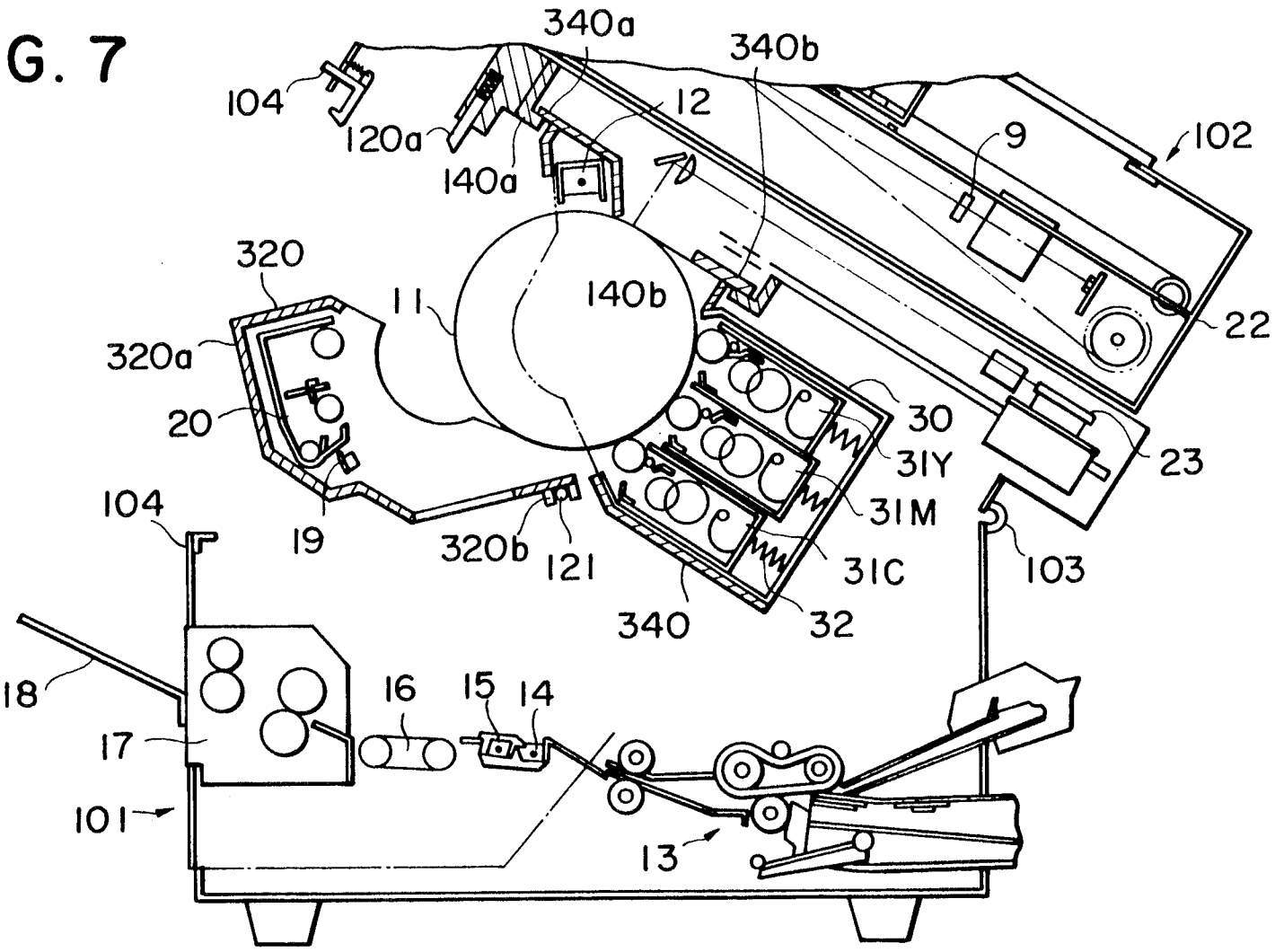
FIG. 7 is a schematic front view showing the state of opened upper frame in the third example.

FIG. 7 shows the third example having functions identical to those in the first example. In this example, photoreceptor drum 11 and developing unit 30 provided therein with developing sub-units 31Y, 31M and 31C are united to be one body of process cartridge 340 which can be mounted or dismounted independently to cleaning unit 320 having therein cleaning device 20. FIG. 7 shows the condition wherein upper framework 102 is opened. Under such a condition, process cartridge 340 provided on its outer wall surface with engaging members **340*a* and 340*b* which are engaging with rail-shaped supporting arms 140*a* and 140*b* provided on upper framework 102 can be drawn out in the direction perpendicular to the figure plane (toward this side of the main body of apparatus). Cleaning unit 320 is a framework having a U-shaped sectional view in which pre-cleaning neutralizing unit 19 and cleaning unit 20 are provided, and engaging member 320*b* provided on cleaning unit 320 is engaging, in a straddling manner, with rotation-supporting shaft 121 protruded in a bar shape from upper framework 102. Under the operational condition, engaging member 320*a* provided on the outer surface of cleaning unit 320 is held by stopper 120*a* provided on upper framework 102, thus the operational position thereof is maintained. In the state that upper framework 102 is opened, therefore, it is possible to take out the cleaning unit 320 in the direction perpendicular to the figure plane, after releasing the stopper 120*a* and rotating the cleaning unit counterclockwise. Since the bottom side and both sides of the cleaning device 20 are covered by cleaning unit 320, toner spewing is prevented when cleaning unit 320** is taken out.

Figure 8:
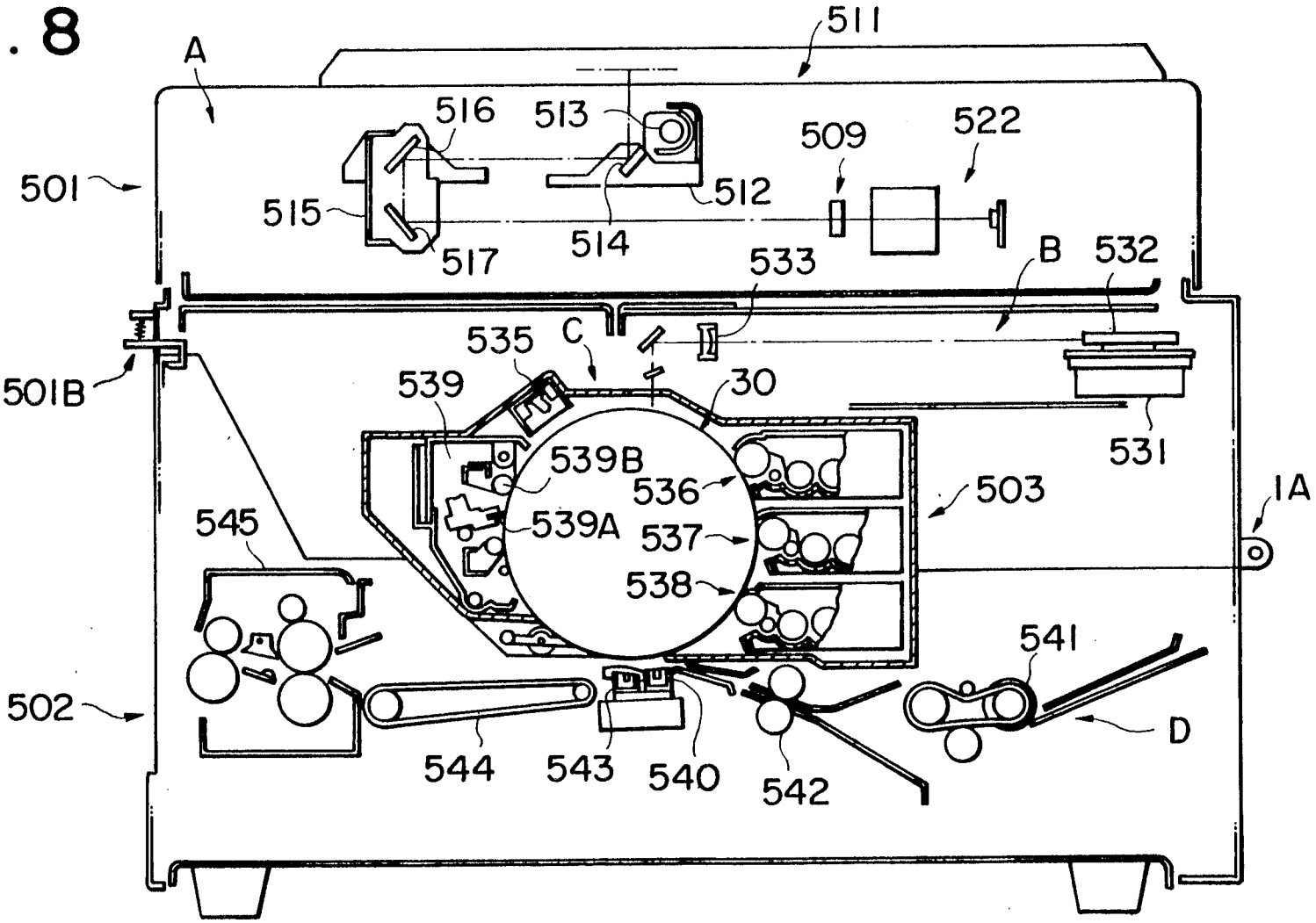
FIG. 8 and FIG. 9 represent a sectional structural diagram of a color forming apparatus showing the fourth example, FIGS. 10 (*a*) and (*b*) represent respectively an illustration and a schematic diagram of the mounting mechanism for a color process unit in aforesaid apparatus.

FIG. 8 represents a color image forming apparatus of a clamshell type showing the fourth example of the invention wherein various units for image-forming are united as a color process unit which can be mounted or dismounted solidly.

The apparatus comprises upper framework 501 capable of being opened and lower framework 502 to be placed stationarily on the floor both of which are combined into one by means of hinge 501A and metallic hook 501B.

Upper framework 501 contains laser-writing unit B and image-reading unit A that is located above the laser-writing unit all of which are united solidly.

Photoreceptor drum 530, charging unit 535, developing sub-units 536, 537 and 538 and cleaning unit 539 constituting on image-forming section C are contained in one container to be a color process unit 503 which is mounted on the aforesaid framework 501.

On the other hand, paper-feeding section D for recording papers, transferring electrode 540, separating electrode 543, fixing unit 545 and others are contained in lower framework 502, which forms, together with a bottom surface of the aforesaid color process unit 503 incorporated in upper framework 501, the conveyance route for recording papers. When the aforesaid upper framework 501 is opened, therefore, the surface of the conveyance route for recording papers is disclosed.

In the aforesaid color image forming apparatus, a color image is formed through the superposing method mentioned below.

In image reading unit A, 511 represents a document table and a document placed on the document table 511 is illuminated by halogen lamp 513 attached on carriage 512 that slides horizontally. Mirrors 516 and 517 are attached on movable mirror unit 515 that also slides horizontally and they lead, together with mirror 514 attached on the aforesaid carriage 512, the light image of the document to image reading section 522. Aforesaid carriage 512 and movable mirror unit 515 are driven by a wire connected to a stepping motor (both not illustrated) to slide in the same direction at the speed of V and $\frac{1}{2}$V respectively.

Color separation is made through filter 509 when image reading section 522 reads a document placed on document table 511. Filter 509 comprises, for example, filter R, filter B and filter ND, any one of which transmits light before the document is read off. When selecting a filter, a filter selection device together with filter 509 is to be moved in the direction perpendicular to the surface of the paper on which FIG. 8 is drawn. Incidentally, filter R, filter G and filter B are the filters which transmit red light, green light and blue light respectively, and filter ND is a neutral density filter arranged to match the human visual sensation and it transmits light of all three colors.

Image signals generated from the aforesaid image reading section 522 are processed in a signal-processing section to be color signals color-separated according to the toner colors and they are input to the aforesaid laser writing unit B.

In the laser writing unit B, a laser beam generated by a semiconductor laser (unillustrated) is subjected to the scanning by means of polygon mirror 532 that is rotated by driving motor 531, then passes through f$\theta$ lens 533, and is deflected by mirror 534 to expose in a thin light beam the surface of photoreceptor drum 530 charged in advance by charging unit 535.

When scanning is started, on the other hand, the beam is detected by an index sensor, and thereby the beam modulation by means of the first color signal is started, and the modulated beam scans the surface of the aforesaid photoreceptor drum 530. Therefore, a latent image corresponding to the first color by the light passed through Blue filter is formed on the surface of photoreceptor drum 530 through the main scanning by means of a laser beam and the sub-scanning by means of the rotation of photoreceptor drum 530.

The latent image is developed by developing sub-unit 536 loaded with yellow(Y) toner to form a toner image on the drum surface. The toner image thus obtained passes, while being retained on the drum surface, under the cleaning unit 539 that is away from the surface of photoreceptor drum 530, to enter the following copy cycle.

Namely, the aforesaid photoreceptor drum 530 is charged again by the aforesaid charging unit 535 and then the second color signal passed through Green filter generated from the signal processing section is input to the aforesaid writing unit B, thus the writing onto the drum surface is made in the same way as in the aforesaid case of the first color signal, to form a latent image. The latent image thus obtained is developed by developing sub-unit 537 loaded with magenta (M) toner as the second color.

The magenta (M) toner image is formed over the aforesaid yellow (Y) toner image formed already.

Developing sub-unit loaded with cyan(C) toner is represented with 538 and it forms a cyan (C) toner image by developing a latent image formed on the drum surface based on the control signals generated from the signal-processing section.

On the sleeve in each of developing sub-units 536, 537 and 538, a bias voltage of D.C. or of DC with additional super-imposed A.C. is applied and jumping development by means of two-component developer that is a visualizing means is made, thus the development is made on photoreceptor drum 530 through a non-contact manner.

A color image thus formed on the surface of photoreceptor drum 530 is transferred, at the transfer electrode 540, onto the top face of a recording paper conveyed from the aforesaid paper-feeding section D. Loosening roller 541 feeds one sheet of recording paper to paper-feed roller 542 being synchronized with timing of transferring.

The recording paper onto which the color image is transferred is separated from the drum surface by the separating electrode 543 and is conveyed by conveyance belt 544 to fixing unit 545 and then is ejected out of the apparatus. On the other hand, the residual toner on the surface of photoreceptor drum 530 from which the recording paper has been separated is removed by the cleaning blade 539A and cleaning roller 539B contacting with photoreceptor drum surface in the aforesaid cleaning unit 539, and after the completion thereof, blade 539A leaves the drum surface for the next process of color image forming.

Figure 9:
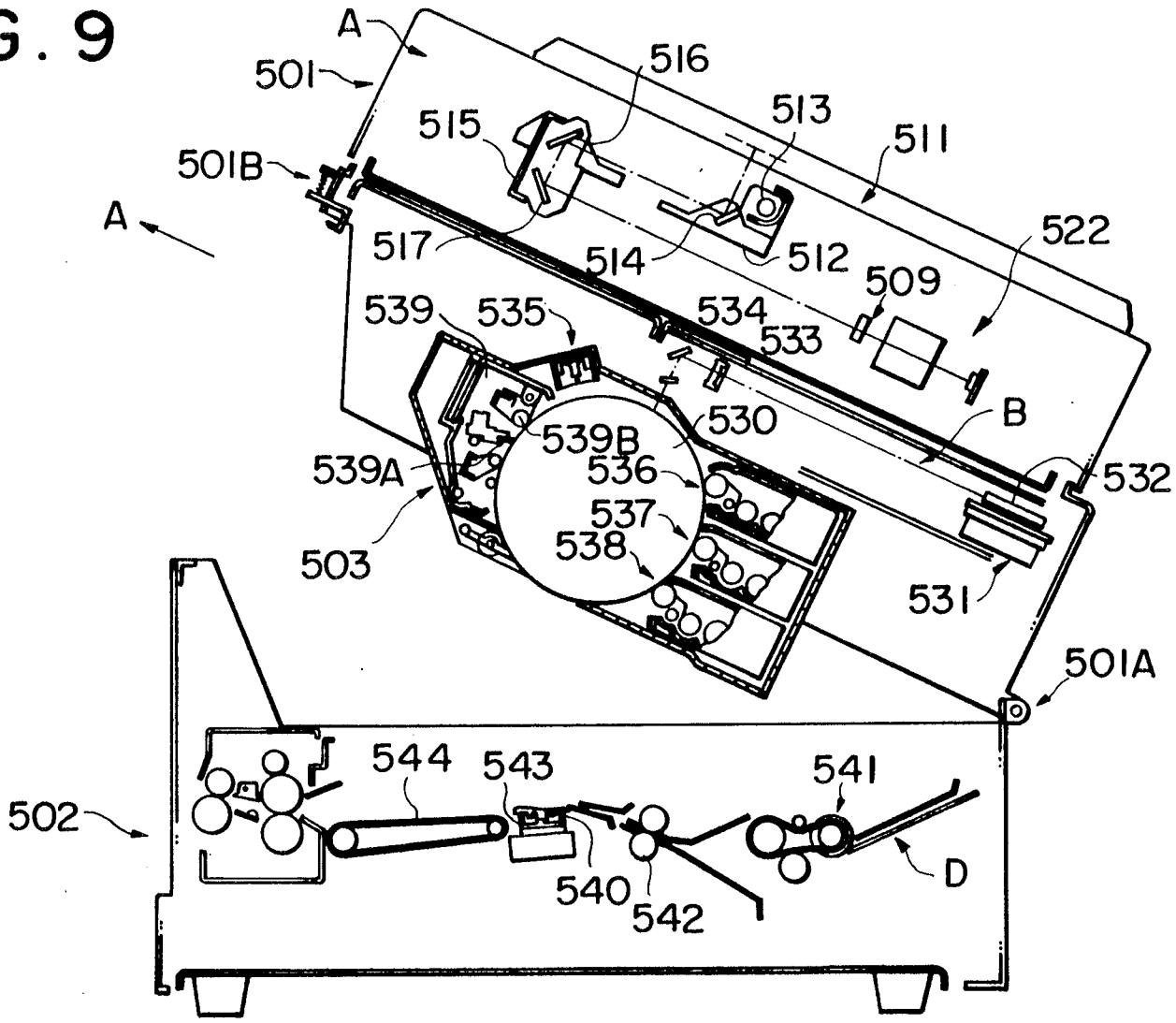

As for the structural arrangement of an apparatus, on the other hand, the aforesaid color image forming apparatus is of a type wherein aforesaid upper framework 501 can swing up to the angle shown in FIG. 9 against the lower framework 502 around hinge 501A to disclose entirely the conveyance plane for recording paper, and under such condition, the aforesaid color process unit 503 can be moved in the arrowed direction A in parallel and can be separated from and taken out of upper framework 501. Thereby, photoreceptor drum 530, developing sub-units 536, 537 and 538 and cleaning unit 539 can easily be cleaned and checked.

When taking out the aforesaid color process unit 503 from the upper framework 501, an opening of every developing sub-unit faces upward. Therefore, it is possible to take it out securely without causing developer to flow out.

Figure 10A:
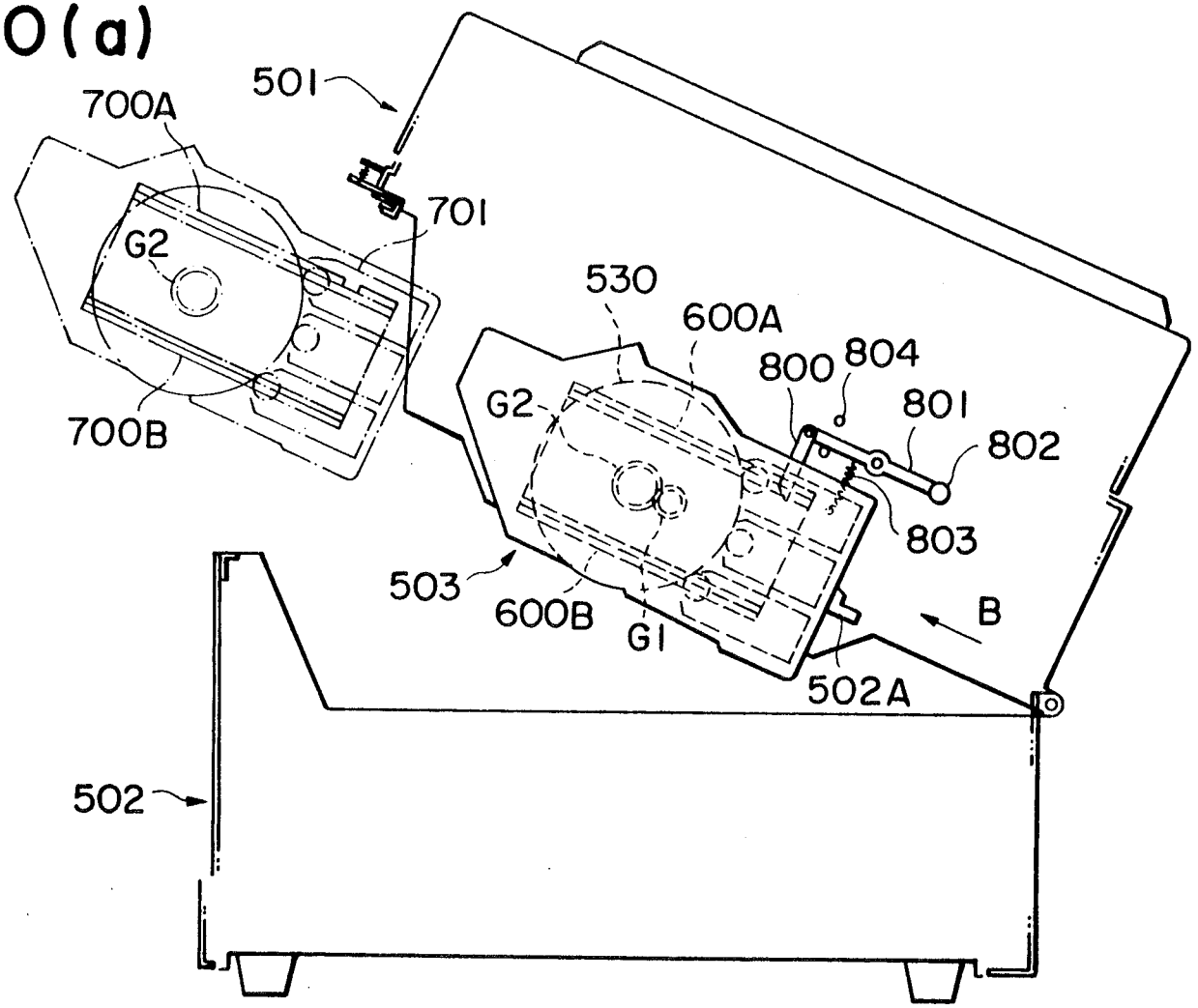
Figure 10B:
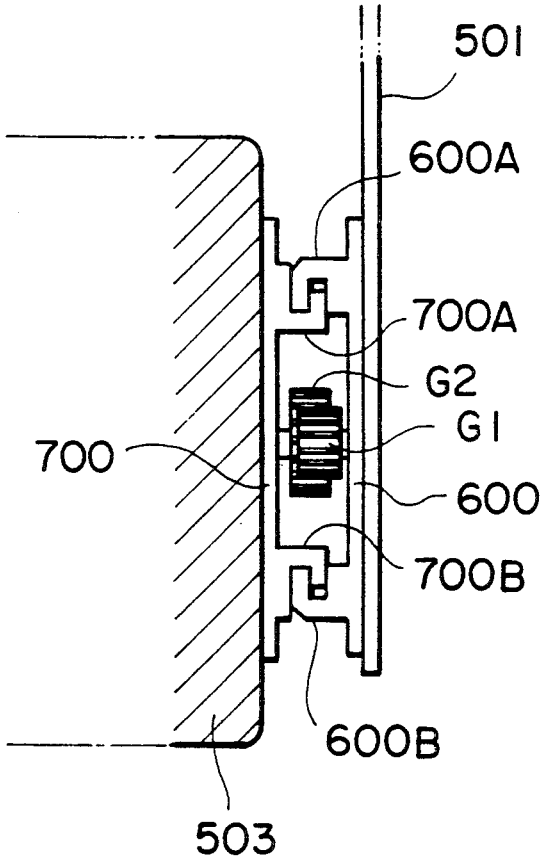

FIG. 10(*a*) shows structural arrangement of how the aforesaid color process unit 503 is contained and supported in upper framework 1 and FIG. 10(*b*) shows the side view thereof as shown by arrow B.

Color process unit 503 in provided fixedly on its back side with rail member 700 wherein rail 700A and rail 700B whose sectional view is shown in FIG. 10(*b*) are arranged in parallel and symmetrical L-shape, while upper framework 501 is provided, on the inner back side, with the guide member 600 wherein U-shaped guide 600A and guide 600B are arranged in parallel and symmetrically, so that guide member 600 faces the rail member 700.

On the same inner side, releasing lever 801 energized counterclockwise by tension spring 803 is supported pivotally and the tip of hook member 800 attached rotatably on one end of the releasing lever is engaged with a hole on the guide 600A at one side of the aforesaid guide member 600, protruding from its sliding surface. Aforesaid releasing level 801 is arranged so that it may be rotated within a range limited by a pair of stop pins 804.

Color process unit 503 can be inserted into upper framework 501 with aforesaid rail member 700 engaging with aforesaid guide member 600 and sliding downward until the stopper 502A is hit, and is held at the prescribed position with cutout 701 provided on rail 700A at one side of rail member 700 engaging with aforesaid hook member 800.

In this position, gear G2 provided coaxially on the shaft of photoreceptor drum 530 engages with driving gear G1 for power transmission provided at a fixed position on upper framework 501 to connect power transmission system, and simultaneously with this, unillustrated electrical connector is connected, thus motive power and electric power may be supplied to each of parts and units constituting the color process unit 503.

On the other hand, when the aforesaid releasing lever 801 is rotated clockwise by means of knob 802, aforesaid hook member 800 is caused to be disengaged with rail member 700. Therefore, color process unit 503 can be slided up obliquely to the left, namely in the arrowed direction A in FIG. 9, to be in a position capable of moving in parallel, thus it is possible to take out color process unit 503 from upper framework 501 by drawing rail member 700 out of guide member 600. When a handle is provided on top of the unit, it causes a easier work.

The present invention can be applied to a color image forming apparatus of a transfer drum type. Upper framework including aforesaid color process unit is opened just like aforesaid examples and lower framework including a transfer drum is fixed rigidly.

Figure 11:
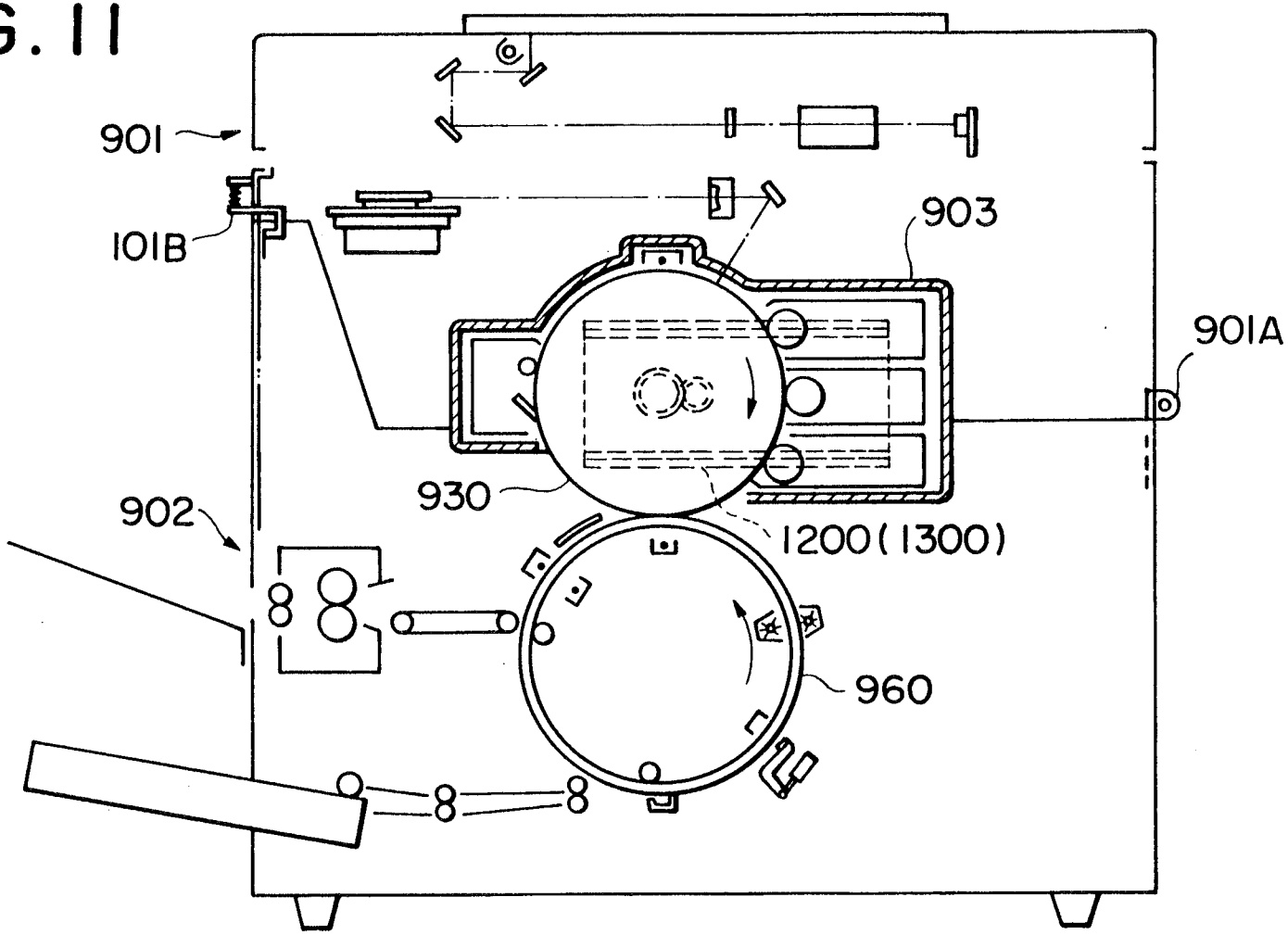
FIG. 11 is a schematic diagram of a color image forming apparatus of a transfer drum type to which the invention is applied.

FIG. 11 represents one example wherein the present invention is applied to a color image forming apparatus of a transfer drum type which is similar to aforesaid fourth example. Even in this case, color process unit 903 is provided with rail member 1200 and upper framework 901 is provided with guide member 1300 and a hook member (unillustrated) same as in the previous example, and it is possible to draw out aforesaid color process unit 903 from upper framework 901 by sliding it upward obliquely, thereby it is possible to disclose the conveyance plane for a recording paper on the peripheral surface of transfer drum 960.

In all of the examples mentioned above, an upper framework is opened clockwise in the drawings, but the invention can be applied also to a color image processing apparatus wherein an upper framework is opened counterclockwise.

In the present invention, it is possible to use a color image reading device wherein a color image sensor is employed. Further, a developing unit in an electrophotographic image forming apparatus can be composed of four developing sub-units which contain respectively yellow (Y), magenta (M), cyan (C) and black (BK) toners. In this case, four turns of the photoreceptor drum form on it the toner images of yellow (Y), magenta (M), cyan (C) and black (BK) colors in the method that each toner color image is formed during one turn of photoreceptor drum and these toner images are recorded onto a recording paper, thus a full color image is obtained.

Image data used in the invention are based on what is inputted from an image reading device, but it is also possible to use other data such as the data made through CAD and or the data from a frame memory wherein transmitted data are stored.

In a color image forming apparatus embodying the invention, the developing unit is of a type wherein three or four developing sub-units are arranged in a superposing style at one side of a photorecepot drum, and when each developing sub-unit is made flat as shown in the example and a sleeve is located at one side thereof and a toner container is located at the other side thereof and a toner container is located at the other side, the developing sub-units can be arranged almost in parallel each other in a developing unit to form a compact process cartridge together with a photoreceptor drum. It is advantageous to make the apparatus of a clamshell type wherein the apparatus is splitted into an upper part and a lower part so that it is easy to draw out the process cartridge and to clear jamming. The invention has the aforesaid effect and it is comparatively easy to open the upper framework because the developing unit which is a heavy portion is near the hinge shaft due to the arrangement where the hinge shaft is provided at the developing unit side. Further, when the process cartridge is drawn out, developers do not spill out or do not mix each other, because the opening of the developing unit is facing upward.

In the invention, the plane for conveying a recording paper is disclosed when an upper framework is opened, and each unit or device of an image forming section can be mounted or dismounted surely and safely without the problem of developer overflowing, thereby it has become possible to provide a color image forming apparatus which can exhibit its functions and efficiency fully due to the easiness of the complete maintenance therefore such as jam clearing and regular maintenance.

What is claimed is:

1. A color image forming apparatus comprising:

an image carrier, having a rotation axis, for carrying a latent image;

a developer including a plurality of developing devices, each of said plurality having a developer storage side for storing a color developer, and a development side opposite said developer storage side, wherein a developing roller for developing said latent image is provided, said plurality being vertically stacked so that said development side of each of said developing devices faces said image carrier, said plurality of developing devices including color developing devices for developing at least yellow, magenta, and cyan color images, said plurality being integrated in a developing unit;

a cleaner for cleaning residual developer remaining on said image carrier after the developed image has been transferred onto a transfer material, said cleaner being integrated with said image carrier to form a process cartridge;

a lower casing; and an upper casing, mounted on said lower casing, said upper casing accommodating said image carrier, said developer, and said cleaner, said developer being detachably installed in said upper casing;

said upper casing being adapted to pivot between an open position and an operation position around an axis parallel to said rotation axis wherein, when said upper casing is pivoted to said open position, said developing devices incline while maintaining the vertically stacked relation, so that said development side of each of said developing devices is raised higher than the corresponding developer storage side, whereby said developing unit and said process cartridge are adapted to separately attach to, or separately detach from, said upper casing, while maintaining an inclined position.

2. The apparatus of claim 1 wherein said process cartridge is attached to, or detached from, said upper casing in a direction parallel to the rotation axis of said image carrier.

3. The apparatus of claim 1 wherein said developing unit is attached to, or detached from, said upper casing in a direction parallel to the rotation axis of said image carrier.

4. A color image forming apparatus comprising:

an image carrier, having a rotation axis, for carrying a latent image;

a developer including a plurality of developing devices, each of said plurality having a developer storage side for storing a color developer, and a development side opposite to said developer storage side, wherein a developing roller for developing said latent image is provided, said plurality being vertically stacked so that said development side of each of said developing devices faces said image carrier, said plurality of developing devices including color developing devices for developing at least yellow, magenta, and cyan color images, said plurality of developing means being integrated with said image carrier;

a cleaner for cleaning residual developer remaining on said image carrier after the developed image has been transferred onto a transfer material, said cleaner being integrated with said image carrier;

a lower casing; and an upper casing, mounted on said lower casing, said upper casing accommodating said image carrier, said developer, and said cleaner, said developer being detachably installed in said upper casing;

said upper casing being adapted to pivot between an open position and an operation position around an axis parallel to said rotation axis wherein, when said upper casing is pivoted to said open position, said developing devices incline while maintaining the vertically stacked relation, so that said development side of each of said developing devices is raised higher than the corresponding developer storage side, whereby the combined image carrier developer and cleaner are attached to, or detached from, said upper casing from an open side of said lower casing and said upper casing, while maintaining an inclined position.

* * * * *